US009006548B2

(12) United States Patent
Bedson

(10) Patent No.: US 9,006,548 B2
(45) Date of Patent: Apr. 14, 2015

(54) DRUMHEAD TUNING RIM APPARATUS AND METHOD OF USE

(71) Applicant: Bryan Thomas Bedson, Costa Mesa, CA (US)

(72) Inventor: Bryan Thomas Bedson, Costa Mesa, CA (US)

( * ) Notice: Subject to any disclaimer, the term of this patent is extended or adjusted under 35 U.S.C. 154(b) by 0 days.

(21) Appl. No.: 14/383,510

(22) PCT Filed: Jan. 7, 2014

(86) PCT No.: PCT/US2014/010532
§ 371 (c)(1),
(2) Date: Sep. 5, 2014

(87) PCT Pub. No.: WO2014/110049
PCT Pub. Date: Jul. 17, 2014

(65) Prior Publication Data
US 2015/0027295 A1 Jan. 29, 2015

Related U.S. Application Data

(63) Continuation of application No. 13/740,148, filed on Jan. 11, 2013, now Pat. No. 8,642,867.

(51) Int. Cl.
*G10D 13/02* (2006.01)

(52) U.S. Cl.
CPC ..... *G10D 13/023* (2013.01)

(58) Field of Classification Search
CPC ..... G10D 13/02; G10D 13/023; G10D 13/00; G10D 13/026; G10G 7/00; G10G 5/00
USPC ..... 84/411 R, 413, 421
See application file for complete search history.

(56) References Cited

U.S. PATENT DOCUMENTS

| | | | | |
|---|---|---|---|---|
| 19,602 A | | 3/1858 | Zimmerman | |
| 795,034 A | | 7/1905 | Harris | |
| 2,495,450 A | | 1/1950 | Gladstone | |
| 3,215,019 A | | 11/1965 | Sloan | |
| 4,742,752 A | * | 5/1988 | Lubbers | 84/413 |
| 5,934,599 A | | 8/1999 | Hammerslag | |

(Continued)

FOREIGN PATENT DOCUMENTS

| | | |
|---|---|---|
| AT | 388463 B | 11/1988 |
| CH | 274881 A | 4/1951 |

OTHER PUBLICATIONS

International Search Report and the Written Opinion of the International Searching Authority PCT/US2014/010532 Aug. 22, 2014.

*Primary Examiner* — Kimberly Lockett
(74) *Attorney, Agent, or Firm* — One3 IP Management, P.C.; Jeromye V. Sartain

(57) ABSTRACT

A drumhead tuning rim apparatus for securing and tuning a drumhead on a drum shell of a drum, the apparatus comprising a plurality of housing grooved bearing wheels rotatably installed spaced along a rim of the drum, the rim being configured for seating over the drumhead on the drum shell, a plurality of lug grooved bearing wheels configured to be rotatably installed spaced about the drum shell substantially between the respective housing grooved bearing wheels, a tensioning cable configured for alternately passing between and about respective housing grooved bearing wheels and lug grooved bearing wheels substantially about the perimeter of the drum shell, and a means for selectively adjusting the tension in the tensioning cable.

20 Claims, 5 Drawing Sheets

(56) References Cited

U.S. PATENT DOCUMENTS

| | | | |
|---|---|---|---|
| 6,202,953 | B1 | 3/2001 | Hammerslag |
| 6,289,558 | B1 | 9/2001 | Hammerslag |
| 7,591,050 | B2 | 9/2009 | Hammerslag |
| 8,091,182 | B2 | 1/2012 | Hammerslag et al. |
| 8,424,168 | B2 | 4/2013 | Soderberg et al. |
| 2012/0246974 | A1 | 10/2012 | Hammerslag et al. |

* cited by examiner

DRUMHEAD TUNING RIM APPARATUS AND METHOD OF USE

RELATED APPLICATIONS

This application claims priority and is entitled to the filing date of U.S. Non-provisional application Ser. No. 13/740,148 filed Jan. 11, 2013, and entitled "Drumhead Tuning Rim Apparatus and Method of Use." The contents of the aforementioned application are incorporated herein by reference.

INCORPORATION BY REFERENCE

Applicant(s) hereby incorporate herein by reference any and all patents and published patent applications cited or referred to in this application.

TECHNICAL FIELD

Aspects of this invention relate generally to musical drums, and more particularly to the hardware for holding a drumhead on a drum shell.

BACKGROUND ART

As is known in the art, musical instruments generally referred to as "drums" are typically comprised of a drum shell and one or more drumheads. The drum shell is usually a hollow annular body of wood or other material having a certain diameter and length or depth. A drumhead is essentially a membrane, traditionally of animal skin and now more often of synthetic fiber such as polyester, Mylar, Kevlar or other suitable material, that is stretched over one or both open ends of the drum shell so as to vibrate and produce a tone when struck by the hand, a drum stick, or other object. Each drumhead is typically formed with a relatively rigid hoop about its perimeter, which is configured to seat on or about an open end of the drum shell. The drumhead may thus be held in place and in tension on the drum shell by affixing it thereto, either with bolts through metal "claws" attached directly to the hoop of the drumhead or with bolts through holes in a flanged rim that fits over the drumhead hoop and effectively pinches or traps the drumhead hoop between the rim and the drum shell. The bolts, called tension rods, are screwed, as with a drum key, into threaded lugs attached to the drum shell in order to secure and tune the drumhead. Depending on the size and style of the drum, ranging from large bass drums to small toms and the classic snare drum, the drum shell and corresponding rim(s) may be configured with six, eight, or twelve tension rod and lug sets or pairs.

The challenge with the prior art system of securing and tuning a drumhead through the conventional tension rod and lug hardware that has been employed for decades is that producing uniform tension all the way around the drumhead hoop or rim as by individually adjusting each tension rod, and thus evenly tuning the drumhead across its entire surface, is difficult and time-consuming. What is needed and has heretofore been unavailable is a more convenient and effective drumhead tuning rim apparatus and method. Aspects of the present invention fulfill these needs and provide further related advantages as described in the following disclosure.

DISCLOSURE OF INVENTION

Aspects of the present invention teach certain benefits in construction and use which give rise to the exemplary advantages described below.

Aspects of the present invention are directed to a drumhead tuning rim apparatus for securing and tuning a drumhead on a drum shell of a drum, the apparatus comprising a plurality of housing grooved bearing wheels rotatably installed spaced along a rim of the drum, the rim being configured for seating over the drumhead on the drum shell, a plurality of lug grooved bearing wheels configured to be rotatably installed spaced about the drum shell substantially between the respective housing grooved bearing wheels, a tensioning cable configured for alternately passing between and about respective housing grooved bearing wheels and lug grooved bearing wheels substantially about the perimeter of the drum shell, and a means configured for selectively adjusting the tension in the tensioning cable.

A primary objective inherent in the above-described apparatus and method of use is to provide advantages not taught by the prior art.

Another objective is to provide such an apparatus and method that enables uniform tuning of a drumhead through the adjustment of a single dial rather than the multiple tension rods in prior art drumhead hardware configurations.

A still further objective is to provide such an apparatus and method that enables removal or installation of a drumhead through the adjustment of a single dial and associated loosening or tightening of a single cable rather than threadably disengaging or engaging the multiple tension rods in prior art drumhead hardware configurations.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

MODES FOR CARRYING OUT THE INVENTION

The above described drawing figures illustrate aspects of the invention in at least one of its exemplary embodiments, which are further defined in detail in the following description.

Figure 1:
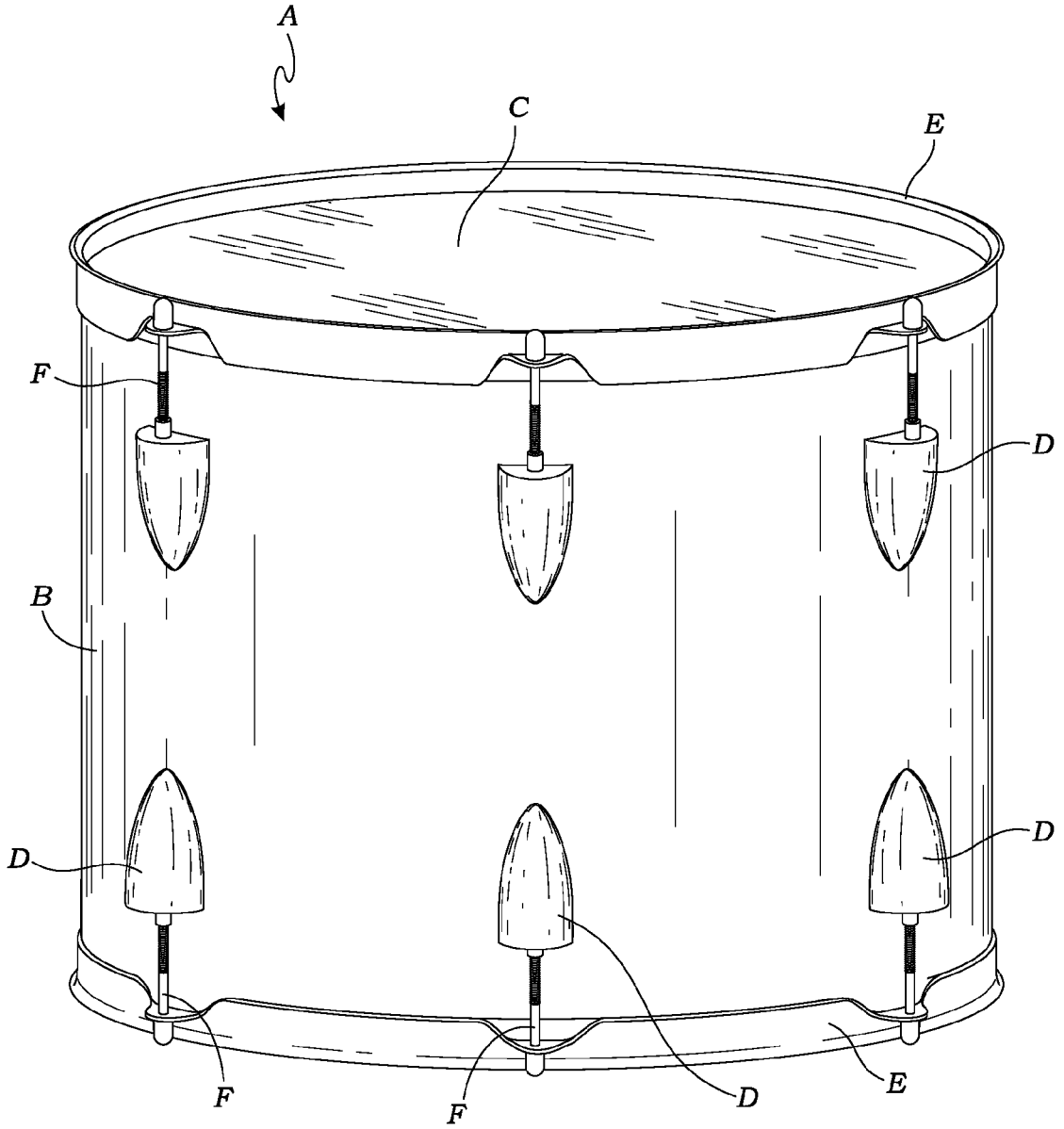
Prior Art Fig. 1
FIG. 1 is a perspective view of an exemplary prior art drum with drumhead mounting hardware.

By way of further background, and with initial reference to FIG. 1 depicting a typical tom-tom drum as is known and used in the art, the drum A is comprised of a drum shell B and one or more drumheads C stretched over one or both open ends of the drum shell B. The drum shell B is configured with lugs D spaced about its circumference, one row of lugs D for each of the top and bottom rims E. Each such rim E is configured to seat about a hoop or edge (not shown) of the drumhead C and so trap or retain the drumhead C about an open end of the drum shell B. The rim E is formed with a flange having through-holes into which are inserted bolts or tension rods F for threadable engagement with the respective lugs D. As such, the drumhead C is tuned in the prior art drum A by selectively tightening or loosening the tension rods F, whether by hand or using a drum key or other tool (not shown), so as to put the desired amount of tension or stretch on the portion of the drumhead C corresponding to the respective tension rod-lug pair. Depending on the size and style of the drum, there may be from six to twelve or more such pairs of tension rods and lugs that would need to be individually adjusted in an effort to create uniform tension over the entire drumhead and thus tune the drum—in the exemplary prior art drum A there are twelve pairs of tension rods F and lugs D, six on the top and six on the bottom, though only three of the pairs on each of the top and bottom, or six pairs total, are visible in the perspective view of FIG. 1. It will be appreciated by those skilled in the art that the typical prior art system for securing and tuning a drumhead through a number of such conventional tension rod and lug hardware pairs is relatively difficult to use and time-consuming even for experienced drummers. Therefore, it is desirable that a more simplistic approach to securing and tuning a drumhead be provided.

Figure 2:
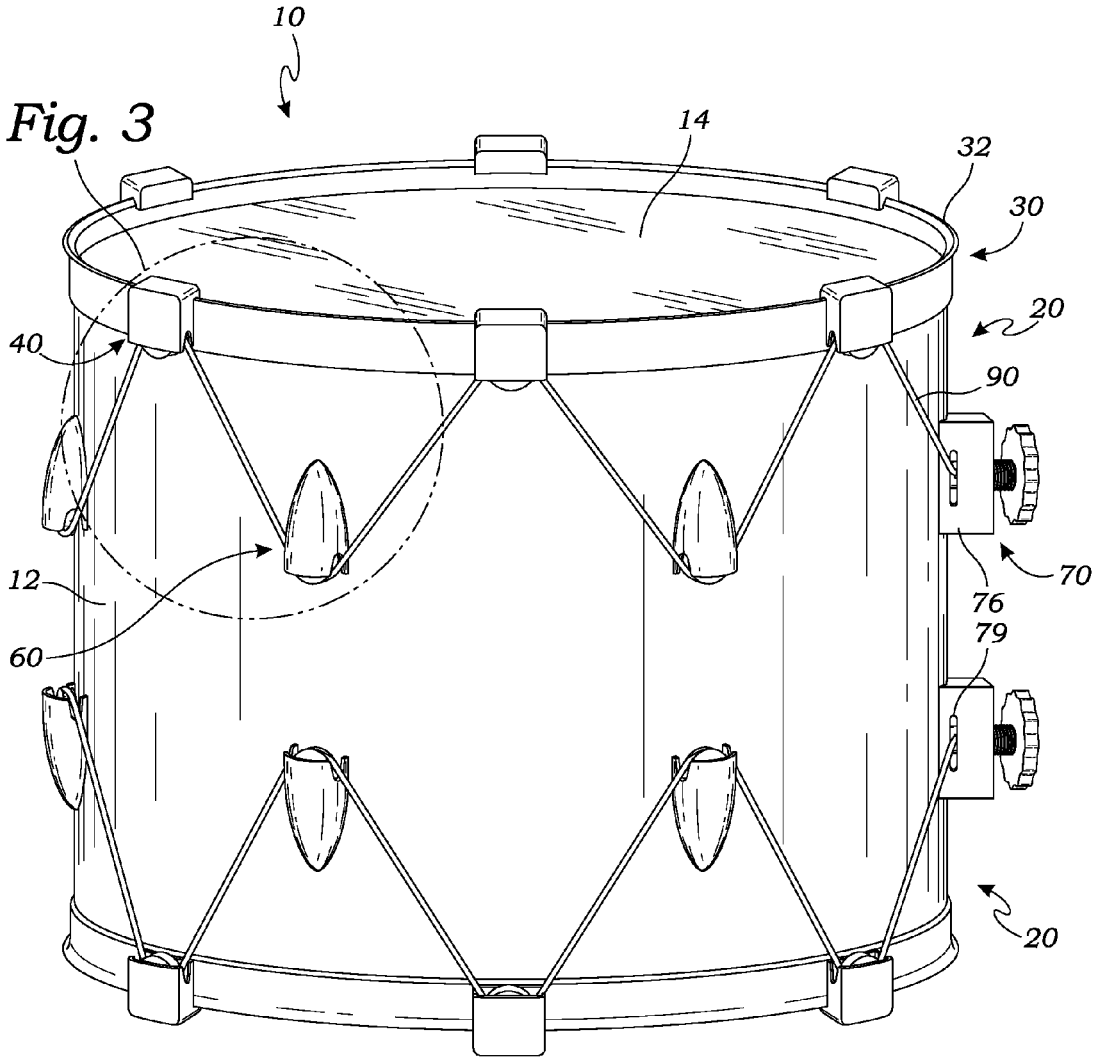
FIG. 2 is a perspective view of an exemplary embodiment of the invention.

Turning now to FIG. 2, there is shown a perspective view of an exemplary embodiment of a drumhead tuning rim apparatus 20 according to aspects of the present invention as employed in connection with a drum 10 having a drum shell 12 and at least one drumhead 14. The apparatus 20 comprises, in one embodiment, a rim 30 configured with spaced-apart grooved bearing wheel housing assemblies 40 about its perimeter and corresponding, spaced-apart grooved bearing wheel lug assemblies 60 installed about the perimeter of the drum shell 12, with a single cable 90 running alternately between the housing assemblies 40 and lug assemblies 60 and terminating at its opposite ends in a cable tension dial assembly 70 also mounted on the drum shell 12 so as to allow, based on the operative cooperation of such components of the apparatus 20, securing and tuning of the drumhead 14 on the drum shell 12 as described further below. As shown in FIG. 2, where the drum 10 has a drumhead 14 positioned on both ends of its hollow drum shell 12, two essentially identical drumhead tuning rim apparatuses 20 may be employed in a similar fashion as herein described, one such apparatus 20 associated with each drumhead 14; it will be appreciated that where a drum is configured as having only one drumhead with the other end of the drum open, only one such drumhead tuning rim apparatus according to aspects of the present invention would thus be employed. For simplicity throughout the instant Specification, though two are shown in the figures, one drumhead tuning rim apparatus 20 is described in terms of its construction and use, the second again being analogous structure and essentially a mirror image of the first. However, in particular applications it may be desirable to configure the tuning rim apparatuses differently from one another in one or more respects even on the same drum, such as when a different effect or functionality of one drumhead versus another is desired or where the drum and particularly the drum shell and thus the sizes and shapes of the respective drumheads are not identical or symmetrical. Those skilled in the art will appreciate that while a particular configuration of the drumhead tuning rim apparatus 20 is shown and described, the invention is not so limited, but instead may take other forms and involve other components and materials now known or later developed without departing from the spirit and scope of the invention.

With continued reference to FIG. 2, a number of grooved bearing wheel housing assemblies 40, six in the exemplary embodiment, are attached or mounted on the rim 30 of the drum 10 at evenly spaced intervals, replacing the traditional tension rod holes formed on the typical hoop rim E (FIG. 1). At substantially equal spacing about the perimeter of the drum shell 12 there are positioned corresponding grooved bearing wheel lug assemblies 60. It is noted that while in the exemplary embodiment there are six grooved bearing wheel housing assemblies 40, there would only be five corresponding grooved bearing wheel lug assemblies 60, as the sixth position about the perimeter of the drum shell 12 between one pair of housing assemblies 40 would instead be taken by the cable tension dial assembly 70, more about which is said below in connection with FIGS. 6 and 7. In the exemplary embodiment, each such lug assembly 60 is located circumferentially substantially midway between the closest two housing assemblies 40. Moreover, the lengthwise offset distance down the drum shell 12 from the rim 30 at which the lug assemblies 60 are located is substantially equal to the circumferential distance from a particular lug assembly 60 to each adjacent housing assembly 40, whereby the angle that the cable 90 bends as it goes through each housing or lug assembly 40, 60 is approximately ninety degrees (90°), though it will be appreciated that this angle can vary depending on a number of factors, such as the desired configuration of the rim 30 and spacing of the housing assemblies 40 thereabout, the type and length of the drum shell 12 and the resulting position thereon of the lug assemblies 60, and the intended drumhead 14 and the amount of tension that is to be put on it, such that it is to be expressly understood that the invention is not limited to the particular positions and spacing of the housing and lug assemblies 40, 60, which are merely illustrative of aspects of the present invention. Relatedly, though the housing assemblies 40 are shown as being at substantially the same locations as would be the tension rods F in a conventional drum A as shown in FIG. 1, or the lug assemblies 60 at substantially the same locations as would be the lugs D, it will be appreciated that such locations of the housing or lug assemblies 40, 60 may vary from those shown without departing from the spirit and scope of the invention. It is noted that while the present invention is shown and described in connection with installation on a drum 10, the components of the drumhead tuning rim apparatus 20 may be sold separately from any drum, such as for an aftermarket installation, in which case it is preferable that the lug assemblies 60 and the cable tension dial assembly 70 be configured to be installed in holes already formed in the drum shell B, or in the locations where the lugs D were originally installed, though again this is not necessary. In any case, it will be appreciated that the components of the drumhead tuning rim apparatus 20, including the rim 30 with housing assemblies 40 thereabout, the lug assemblies 60, the cable tension dial assembly 70, the tensioning cable 90, and assorted bolts and nuts or other fasteners and the like, may be sold as a kit, whereby any prior art drum A can be converted from a conventional tension rod and lug rim securing and tuning system to a "dial-tune" system according to aspects of the present invention. Therefore, while the present invention is shown and described in the context of installation on a drum 10, it is to be understood that the drumhead tuning rim apparatus 20 may exist apart from any such drum, particularly for the purpose of distribution and sales.

Figure 3:
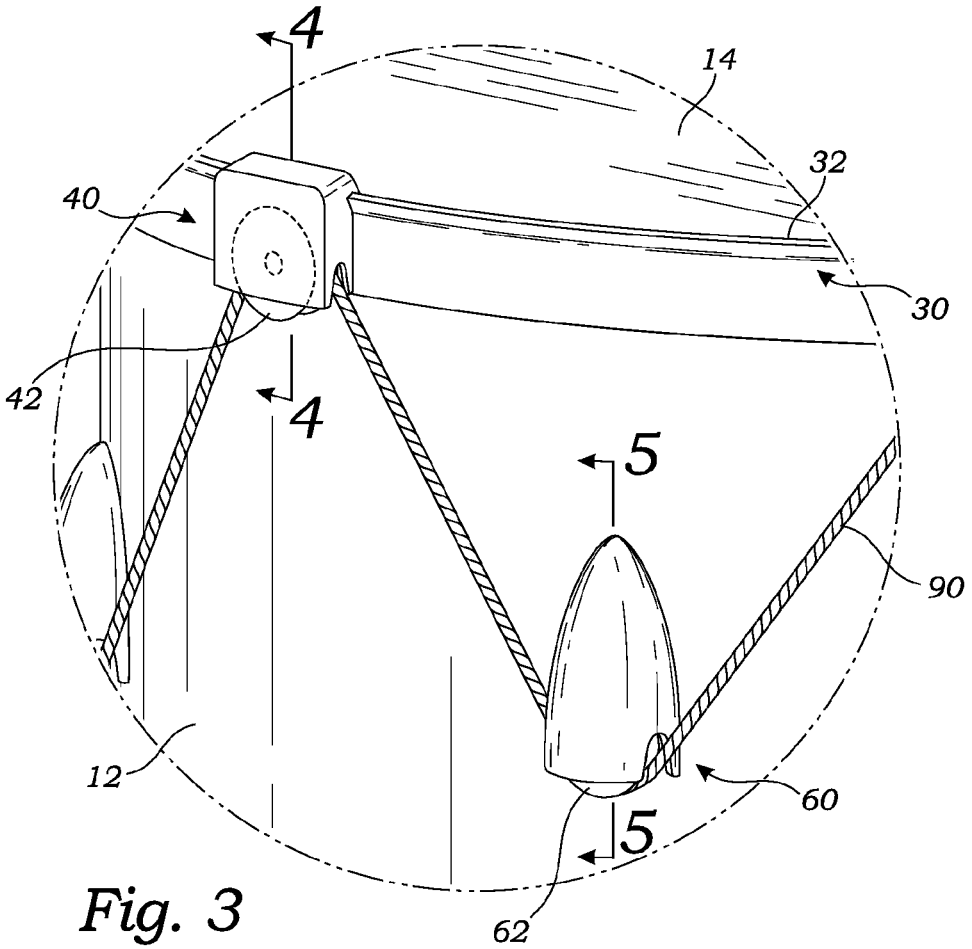
FIG. 3 is an enlarged partial perspective view thereof taken from circle "FIG. 3" of FIG. 2.

Referring next to FIG. 3, there is shown an enlarged partial perspective view of a portion of the drumhead tuning rim apparatus 20 including one each of a grooved bearing wheel housing assembly 40 and an adjacent grooved bearing wheel lug assembly 60 with the tensioning cable 90 passing therebetween on its way around the entire perimeter of the drum shell 12 alternating between such housing and lug assemblies 40, 60 as best shown in FIG. 2. Each housing and lug assembly 40, 60 is thus configured with a grooved bearing wheel 42, 62, respectively, about which the cable 90 runs in a relatively low friction manner as it passes through each component in forming the drumhead tuning rim apparatus 20. In this regard, it will be appreciated that in alternate embodiments the apparatus 20 may not have any wheels 42, 62, but may instead provide other low friction or sliding surfaces on which the cable 90 may run. In a bit more detail, and with reference now to FIG. 4, an enlarged cross-sectional view of the grooved bearing wheel housing assembly 40, the housing grooved bearing wheel 42 is formed having a housing central axle 44 that seats in opposite housing channels 48 formed in the housing body 46, such that the housing grooved bearing wheel 42 is rotatably installed within the housing body 46. At the top of the housing body 46 there is further formed a somewhat downwardly-projecting angled flange 50 defining a somewhat downwardly-opening notch 52 within which a corresponding somewhat upwardly extending circumferential upper rim flange 32 of the rim 30 seats in securing the grooved bearing wheel housing assembly 40 on the rim 30. It will be appreciated that while such an interference or tongue-and-groove type installation of the grooved bearing wheel housing assembly 40 on the rim 30 is shown and described, virtually any assembly technique for securing the housing assemblies 40 about the rim 30, whether permanent or selectively removable or now known or later developed, may be employed in the present invention without departing from its spirit and scope, including but not limited to set screws, bolts, cross-pins, rivets, adhesives, snaps, slotted engagement, spring clips, spot or tack welding, or crimping. It will be further appreciated that the housing body 46 may take any shape or form as desirable in operably containing the housing grooved bearing wheel 42, while in the exemplary embodiment such housing body 46 is configured to be relatively low profile and essentially just large enough to house the housing grooved bearing wheel 42 substantially hidden from view, with notches or the like formed in the side walls of the housing body 46 as needed for free movement of the tension cable 90 about the housing grooved bearing wheel 42; accordingly, any such housing structure capable of functioning as herein described may be employed in the present invention without departing from its spirit and scope. Furthermore, in alternate embodiments, there may be no such housing body 46 at all, but instead such structure, and the housing grooved bearing wheel 42 or other such low friction contact surface for the cable 90, particularly, may be integral with the rim 30 itself.

Figure 5:
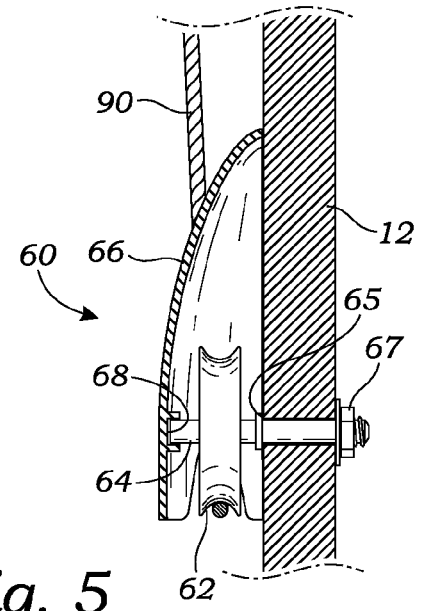
FIG. 5 is an enlarged cross-sectional view taken along line 5-5 of FIG. 3.

Referring to FIG. 5, another enlarged cross-sectional view, the complimentary grooved bearing wheel lug assembly 60 is shown as being configured similarly to the grooved bearing wheel housing assembly 40, with a lug body 66 in which is formed, here, one lug channel 68 wherein one end of a lug central axle 64 of the lug grooved bearing wheel 62 is seated. Rather than being supported at the axle 64's opposite end by another channel formed in the lug body 66, the back of the lug body 66 toward the drum shell 12 is open, and the axle 64 extends inwardly through the lug grooved bearing wheel 62 and a corresponding cross-hole formed in the drum shell 12 to thereby fasten the grooved bearing wheel lug assembly 60 onto the drum shell 12. Specifically, in the exemplary embodiment, the lug central axle 64 is formed opposite its free end that seats in the lug channel 68 with an axle flange 65 configured to abut the drum shell 12 and so space the lug grooved bearing wheel 62 away from the drum shell 12 for free rotation within the lug body 66 about the lug axle 64. The opposite end of the lug axle 64 is then threaded for receipt of a nut 67, with or without a washer, in the conventional fashion, whereby the axle 64 is secured to the drum shell 12 by clamping the shell 12 between the axle flange 65 and a nut 67. Once more, while a particular means for securing the grooved bearing wheel lug assembly 60 onto the drum shell 12 is shown and described, it will be appreciated that any installation method and related hardware, whether permanent or selectively removable or now known or later developed, may be employed without departing from the spirit and scope of the invention. Specifically, the end of the axle 64 may be secured within the channel 68 such that the lug body 66 is thereby also secured to the drum shell 12 by way of the axle 64; or the lug body 66 may be separately installed on the drum shell 12 employing any appropriate means now known or later developed. Moreover, while the lug body 66 is shown as having a somewhat teardrop shape for aesthetic purposes, it is to be appreciated that any styling will do as long as it does not compromise function. Relatedly, the lug body 66 in the exemplary embodiment is configured such that the lug grooved bearing wheel 62 is substantially hidden by the lug body 66, with slots or notches formed in the lug body 66 as needed for passage of the cable 90 even with the lug grooved bearing wheel 62 tucked up under the lug body 66 as shown. Again, those skilled in the art will appreciate that such aesthetic considerations and related form and function of the components may vary from that shown without departing from the spirit and scope of the invention. For example, there need not be a lug body 66 necessarily at all, wherein the lug grooved bearing wheel 62 or other such low friction sliding surface for the cable 90 may be installed directly on or somehow incorporated into the drum shell 12 itself.

Figure 6A:
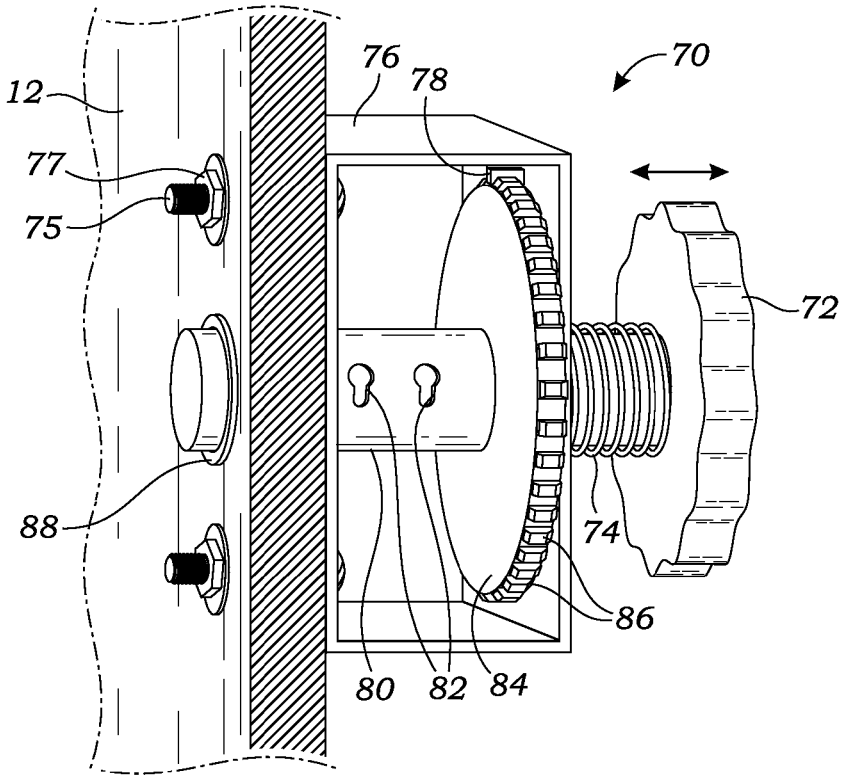
FIGS. 6A and 6B are enlarged partial perspective views thereof in two operative states.
Figure 6B:
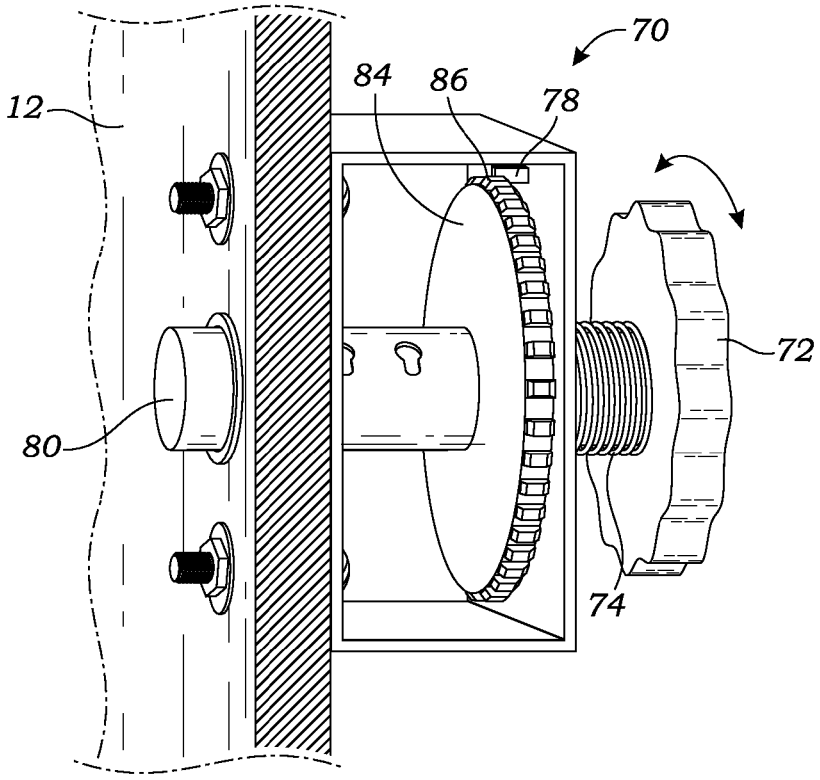

Turning now to FIGS. 6A and 6B, there are shown enlarged partial perspective views of the cable tension dial assembly 70 of the drumhead tuning rim apparatus 20 in two operative states. For simplicity and ease of viewing the inner components of the cable tension dial assembly 70, the side portion or side wall of the cable tension dial body 76 is removed and the tension cable 90 (FIG. 2) is not shown. Generally, the cable tension dial assembly 70 comprises a knob or dial 72 installed on a geared shaft 80 operable within the cable tension dial body 76 for selective rotation as by turning the dial 72 so as to increase or decrease the tension in the cable 90 (FIG. 2). In a bit more detail, the dial body 76 is configured as a substantially box-like enclosure that may be installed on the drum shell 12 in any appropriate manner, though as shown this is accomplished through a pair of small bolts 75 and associated nuts 77, with or without washers. It will be appreciated by those skilled in the art that virtually any assembly technique for securing the one or more cable tension dial assemblies 70 on the drum shell 12, whether permanent or selectively removable or now known or later developed, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the shaft 80 with gear 84, while in the exemplary embodiment such dial body 76 is configured to be relatively low profile and essentially just large enough to house an operably sized shaft 80 and gear 84. As best seen in FIG. 2, the dial body 76 in the exemplary embodiment forms a substantially complete enclosure about the moving parts shown in FIGS. 6A and 6B of the cable tension dial assembly 70, with small slots or openings 79 formed in the dial body 76 at appropriate locations for the passage therethrough of the tension cable 90. Small rollers or other such reduced friction surface may be employed in or about the openings 79 as needed in allowing for the relatively free or guided movement of the cable 90 therethrough during use of the drumhead tuning rim apparatus 20 as described further below. Accordingly, any such housing structure capable of functioning as herein described may be employed in the present invention in connection with the cable tension dial assembly 70 without departing from its spirit and scope.

With continued reference to FIGS. 6A and 6B, positioned substantially centrally within the cable tension dial body 76 is the shaft 80, passing through one or more substantially axially aligned openings (not shown) in the dial body 76 and, in the exemplary embodiment, the drum shell 12. It will be appreciated that in alternate embodiments wherein the dial body 76 is sufficiently spaced from the drum shell 12 or the shaft 80 is otherwise operably supported on both ends spaced from the drum shell 12, an opening for the shaft 80 in the drum shell 12 itself would not be necessary. However, in the exemplary embodiment, in the interest of further supporting the shaft 80 and flushing to the extent possible the cable tension dial assembly 70 on the drum shell 12, the shaft 80 is shown as at least partially passing through the drum shell 12 as through a hole therein (not shown), in which case, though the dial body 76 is shown as having a rear wall immediately adjacent the drum shell 12, it will be appreciated that such wall may be eliminated in whole or in part, particularly where alternate assembly techniques for securing the cable tension dial assemblies 70 on the drum shell 12 are employed. To facilitate relatively frictionless axial and rotational movement of the shaft 80 through such drum shell hole or any opening in the dial body 76, a bushing 88 or the like may be positioned therein. Along the shaft 80 within the dial body 76 there is installed a gear 84 having multiple teeth 86. And between the gear 84 and the drum shell 12 there are formed in or along the shaft 80 one or more shaft holes 82 configured for receipt therein of the free ends of the tension cable 90 as it starts and ends within the cable tension dial assembly 70. In this way, it will generally be appreciated by those skilled in the art that with the ends of the cable 90 attached or secured to the shaft 80 in any appropriate manner now known or later developed and the rest of the cable 90 passing alternately through the housing and lug assemblies 40, 60 of the drumhead tuning rim apparatus 20, as above-described in connection with FIGS. 2-5, rotation of the shaft 80 will effectively increase or decrease the tension in the cable 90 and thus raise or lower the overall pitch of the drumhead 14 (FIG. 2) as explained further below. In the exemplary embodiment, the gear 84 is relatively fine-toothed for relatively small incremental ratcheting of the tension in the cable 90, though it will be appreciated that any configuration of the gear 84 and its teeth 86 or other such mechanical means for incrementally rotating the shaft 80 and thus increasing or decreasing the tension in the cable 90 may be employed without departing from the spirit and scope of the invention. At least one pin 78 is formed on the inside of the dial body 76 so as to selectively engage the teeth 86 of the gear 84. Thus, it will be appreciated that when the gear teeth 86 are in contact with the pin 78, the gear 84 and thus the shaft 80 is unable to rotate, thereby "locking" the cable tension as shown in the first operational state of FIG. 6A. While if the shaft 80 is pushed inwardly or in axially toward the drum shell 12, the teeth 86 of the gear 84 would thus be disengaged from the pin 78, thereby allowing the shaft 80 to freely rotate and the tension in the cable 90 to be adjusted as shown in the second operational state of FIG. 6B. Pushing or pulling on or rotating the shaft 80 is facilitated by the dial 72 installed on the free or proximal end of the shaft 80 outside of the dial body 76. In the exemplary embodiment, the dial 72 is formed having an overall size and shape and with grooves, bumps, ribs, knurls or other such surface features to enhance grasping or manipulating the dial 72 in a manner known in the art. It will be appreciated that any appropriate form of the dial 72 accounting for ergonomic, manufacturing and assembly, or other such considerations may be employed in the present invention without departing from its spirit and scope. About the shaft 80 between the dial 72 and the dial body 76 there is positioned a compression spring 74 configured to bias the shaft 80 outwardly such that the gear 84 abuts the inside surface of the dial body 76 and the gear teeth 86 are thereby engaged with the pin 78, once again "locking" the dial assembly 70 and so "setting" the cable tension and thus the particular tuning of the drumhead 14 (FIG. 2). Those skilled in the art will appreciate that alternative configurations of the cable tension dial assembly 70 and its components are possible without departing from the spirit and scope of the present invention. For example, it is possible that the gear 84 could be located at the other end of the shaft 80, whether still within the dial body 76 and potentially resulting in the shaft 80 being pulled rather than pushed to disengage the gear teeth 86 from a pin or the like, or even positioning the gear 84 on the far end of the shaft 80 inside the drum shell 12 and otherwise operating much as described above, thereby potentially further flushing the dial assembly 70 with the drum 10 (FIG. 2) or reducing its overall size, particularly on the outside of the drum as a protrusion. Moreover, the pin 78 may be spring-loaded rather than fixed in order to lock the gear 84 from turning. In this way, when turning the dial 72 and thus the shaft 80 to tighten the cable 90 (FIG. 2), it is not necessary to push in or pull out on the dial 72 in order to free the gear 84; instead, simply rotating the dial 72, in the exemplary embodiment clockwise, would tighten the cable "click by click," locking into place at a particular tension with each "click," and then to loosen the cable, one would simply push in on the dial 72 as described above to release. It will be further appreciated that any and all such components of the drumhead tuning rim apparatus 20 may be formed of any suitable material, such as metal or plastic, through any suitable fabrication process, such as molding, casting, machining, stamping, or forming, whether now known or later developed.

Figure 4:
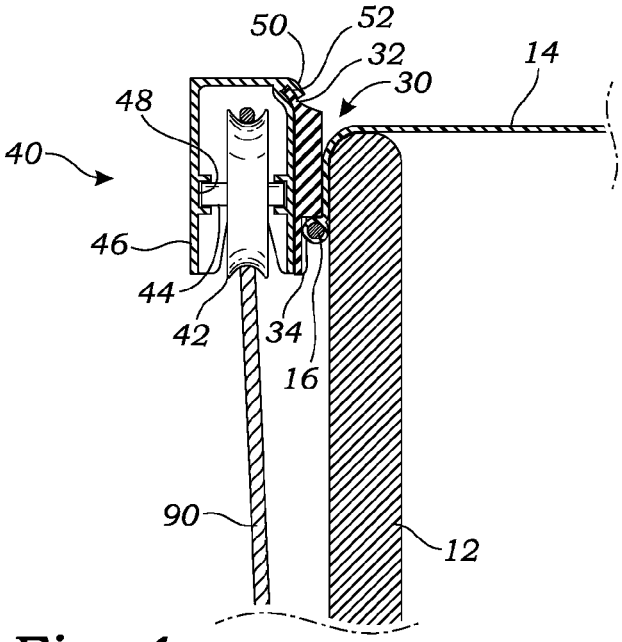
FIG. 4 is an enlarged cross-sectional view taken along line 4-4 of FIG. 3.
Figure 7:
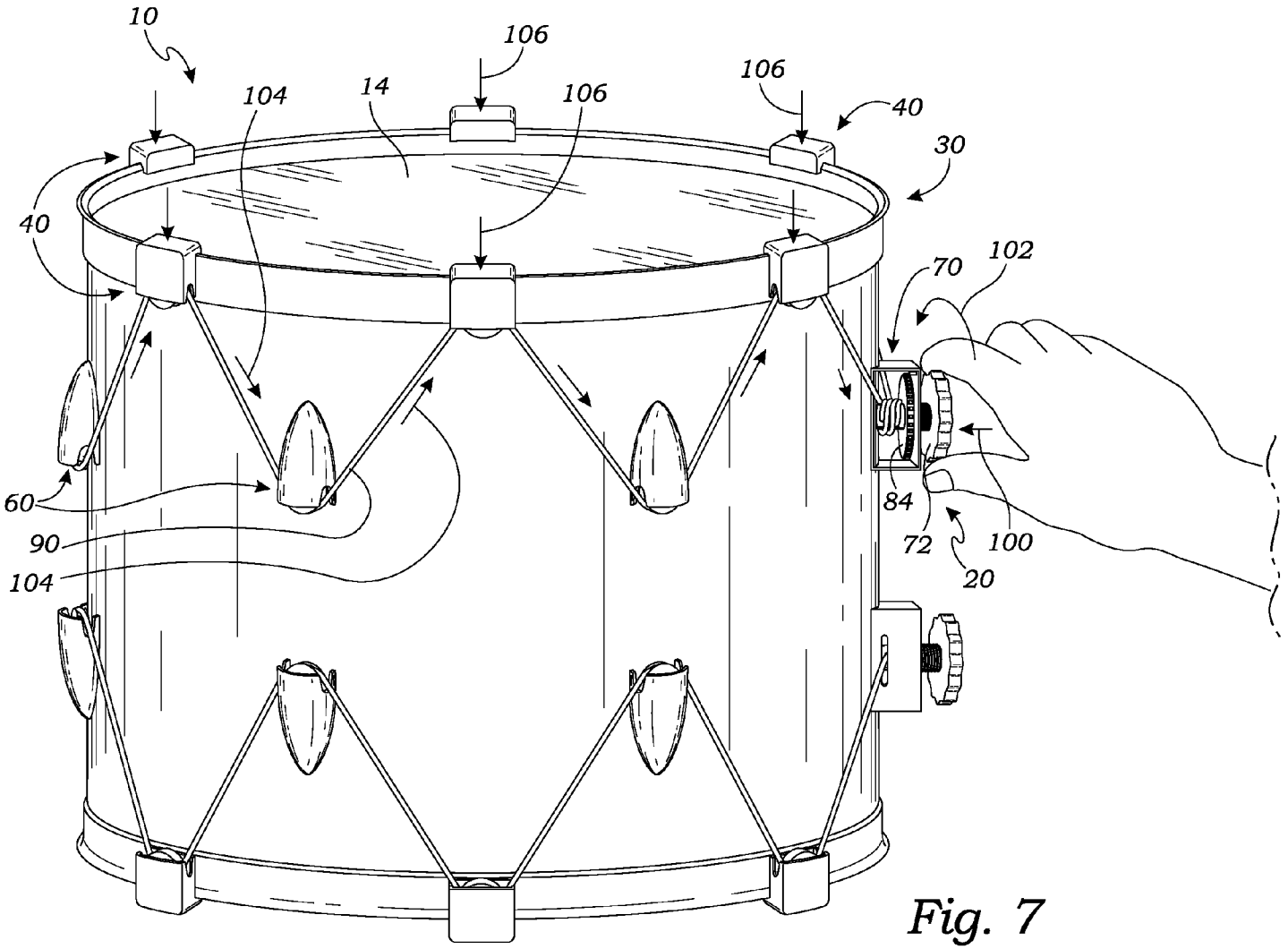
FIG. 7 is a perspective view of the exemplary embodiment of FIG. 2 in use.

Referring now to FIG. 7, in use of the drumhead tuning rim apparatus 20 of the present invention as shown and described in connection with the exemplary embodiment of FIGS. 2-6, installation begins with passing the thin gauge steel cable 90 through each of the grooved bearing wheel housing assemblies 40 on the rim 30, leaving the two ends of the cable 90 facing each other between any two of the grooved bearing wheel housing assemblies 40. To mount the drumhead 14, it is simply placed on top of the drum shell 12 in the conventional manner, and then the rim 30 with steel cable 90 in place passing through the grooved bearing wheel housing assemblies 40 is positioned over the drumhead 14 so that the free ends of the cable 90 are substantially adjacent the corresponding cable tension dial assembly 70 and there is substantially equal spacing between the grooved bearing wheel housing assemblies 40 and the grooved bearing wheel lug assemblies 60. It is particularly noted with reference to FIG. 4 that the rim 30 is formed in the conventional manner with a downwardly-opening recess 34 within which is seated the hoop 16 typically formed about the perimeter edge of the drumhead 14 for trapping the drumhead 14's perimeter between the rim 30 and drum shell 12, thus allowing the drumhead 14 to be secured and pulled taught as the rim 30 is tightened down, by individual tension rods F and threaded lugs D in the prior art approach (FIG. 1) or by the operation of the single dial 72 as in the present invention. Once the rim 30 is properly positioned over the drumhead 14 on the drum shell 12, the still loose cable 90 between each grooved bearing wheel housing assembly 40 may be pulled down and looped under the respective grooved bearing wheel lug assembly 60 mounted around the drum shell 12, being careful that the cable 90 is properly seated on each grooved bearing wheel 42, 62 (FIGS. 3-5). In this manner the cable 90 passes alternately from housing 40 to lug 60 to housing 40 around the drum 10. Next, in the case of a first time installation, the free ends of the cable 90 are attached to the shaft 80 of the cable tension dial assembly 70, such as by fitting a metal notch or crimped connector (not shown) on each end of the cable 90 into the fitted or keyed slot or hole 82 in the shaft 80 (FIG. 6). Once the cable 90 is thus secured to the shaft 80 of the cable tension dial assembly 70, simply pressing in on the dial 72 as indicated by arrow 100 disengages the gear 84 as above-described; turning the dial 72 as indicated by arrow 102 then winds the cable 90 about the shaft 80 until the slack is taken out of the cable 90 at all points. Further turning with the dial 72 still pushed in then tightens the cable 90 and thereby increases tension in the cable 90 as indicated by arrows 104, which results in substantially equal downward force at each of the grooved bearing wheel housing assemblies 40 as indicated by arrows 106, and thus across the entire rim 30, resulting in substantially uniform tautness or tuning of the drumhead 14. Once the drum 10 is in tune as desired, pulling out on or simply releasing the dial 72 again locks the gear 84 in place and thereby holds the desired tension on the cable 90. The drum 10 now has the drumhead 14 installed and is in tune. It will be appreciated that once any drum 10 is so configured with a drumhead tuning rim apparatus 20 according to aspects of the present invention, replacing a drumhead 14 does not require complete disassembly or removal of the cable 90 from the cable tension dial assembly 70 such that the above steps must be repeated from the beginning Rather, by simply loosening the cable 90 enough, or putting sufficient slack in the cable 90 as by pushing in the dial 72 and turning it opposite the direction it was tightened so as to "unwind" the cable 90 from the shaft 80, the cable 90 can be removed from underneath the grooved bearing wheel lug assemblies 60, and the rim 30 can simply be lifted off the drum shell 12 and the current drumhead 14 slipped out and a new one slipped in. The rim 30 can then once more be seated on the drumhead 14, again being careful to position the rim 30 such that the housing assemblies 40 are substantially equally spaced from the respective lug assemblies 60, the cable 90 looped beneath the grooved bearing wheel lug assemblies 60, and the dial 72 simply turned to retighten the cable 90 and tune the drum 10 as desired.

There are obvious advantages of the drumhead tuning rim apparatus 20 of the present invention over the traditional lug D and tension rod F arrangement. First is the ease with which the drum 10 can be tuned and re-tuned. A person need not be a professional drummer or stage hand to relatively easily and effectively tune the drum 10 to the sound desired. According to aspects of the exemplary embodiment of the invention, simply pressing in the dial 72, turning to tune, and pulling out or releasing the dial 72 to lock it in place is essentially all that is required. One dial and no drum key means that tuning takes a matter of seconds as opposed to the old method of tuning the drum to itself one tension rod F at a time before raising or lowering the over-all pitch, which itself still required adjusting each of six to twelve tension rods F by the same amount to keep the drum in tune with itself across the head C while adjusting the pitch. Not only is this prior art approach time consuming, but it is very difficult to be precise and it is a daunting task to many drummers. With the present invention, the drum 10 will consistently be substantially in tune with itself, with the pitch of the drum raised or lowered to achieve the desired sound simply with the turn of a single dial 72. Another advantage of the present invention is the relative speed and ease of changing out an old or torn drumhead 14. Rather than removing each individual tension rod F before being able to remove the rim E and thus the drumhead C, with the present invention it is as simple as pressing in on the dial 72 and letting the cable 90 go slack and then slipping the cable 90 from under each bearing lug 60, whereby the rim 30 and drumhead 14 are ready to come off. Installation of the new drumhead 14 is essentially just as easy by following these same steps in reverse.

To summarize, regarding the exemplary embodiments of the present invention as shown and described herein, it will be appreciated that a drumhead tuning rim apparatus is disclosed and configured for keyless drumhead mounting and tuning to replace the standard six, eight, or twelve lug and tension rod system that is currently used on most traditional drum kit snares, toms, and bass drums. Because the principles of the invention may be practiced in a number of configurations beyond those shown and described, it is to be understood that the invention is not in any way limited by the exemplary embodiments, but is generally directed to a drumhead tuning rim apparatus and is able to take numerous forms to do so without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A drumhead tuning rim apparatus for securing and tuning a drumhead on a drum shell of a drum, comprising:

a plurality of low friction housing assemblies configured to be installed spaced along a rim of the drum, the rim being configured for seating over the drumhead on the drum shell;

a plurality of low friction lug assemblies configured to be installed spaced about the drum shell substantially between the respective housing assemblies;

a tensioning cable configured for alternately passing between and about respective housing and lug assemblies substantially about the perimeter of the drum shell; and a cable tension dial assembly configured to be operably positioned on the drum shell and to receive opposite ends of the tensioning cable, whereby with the apparatus installed on the drum operation of the cable tension dial assembly effectively increases or decreases tension in the tensioning cable and thus raises or lowers the overall pitch of the drumhead.

2. The apparatus of claim 1 wherein the cable tension dial assembly comprises:

a cable tension dial body installed on the drum shell;

a shaft operable within the cable tension dial body and configured for engagement with the tensioning cable; and a dial installed on the shaft for operation thereof, whereby rotation of the shaft as through operation of the dial effectively increases or decreases tension in the tensioning cable and thus raises or lowers the overall pitch of the drumhead.

3. The apparatus of claim 2 wherein:

a gear having multiple teeth is installed on the shaft; and at least one pin is formed on the dial body so as to selectively engage the teeth of the gear, whereby engagement of the gear teeth with the pin effectively locks the cable tension dial assembly and so sets the cable tension and thus the particular tuning of the drumhead.

4. The apparatus of claim 1 wherein the housing assemblies are to be removably installed on the rim.

5. The apparatus of claim 1 wherein the housing assemblies each comprise a rotatable housing grooved bearing wheel.

6. The apparatus of claim 1 wherein the lug assemblies are to be removably installed on the drum shell.

7. The apparatus of claim 1 wherein the lug assemblies each comprise a rotatable lug grooved bearing wheel.

8. The apparatus of claim 1 wherein the cable tension dial assembly is to be removably installed on the drum shell.

9. A kit for retrofitting the drum comprising the apparatus of claim 1.

10. A drumhead tuning rim apparatus for securing and tuning a drumhead on a drum shell of a drum, comprising:

a plurality of low friction housing assemblies installed spaced along a rim configured for seating over the drumhead on the drum shell;

a plurality of low friction lug assemblies configured to be installed spaced about the drum shell substantially between the respective housing assemblies;

a tensioning cable configured for alternately passing between and about respective housing and lug assemblies substantially about the perimeter of the drum shell; and a cable tension dial assembly configured to be operably positioned on the drum shell and to receive opposite ends of the tensioning cable, whereby with the apparatus installed on the drum operation of the cable tension dial assembly effectively increases or decreases tension in the tensioning cable and thus raises or lowers the overall pitch of the drumhead.

11. The apparatus of claim 10 wherein the cable tension dial assembly comprises:

a cable tension dial body installed on the drum shell;

a shaft operable within the cable tension dial body and configured for engagement with the tensioning cable; and a dial installed on the shaft for operation thereof, whereby rotation of the shaft as through operation of the dial effectively increases or decreases tension in the tensioning cable and thus raises or lowers the overall pitch of the drumhead.

12. The apparatus of claim 11 wherein:

a gear having multiple teeth is installed on the shaft; and at least one pin is formed on the dial body so as to selectively engage the teeth of the gear, whereby engagement of the gear teeth with the pin effectively locks the cable tension dial assembly and so sets the cable tension and thus the particular tuning of the drumhead.

13. The apparatus of claim 10 wherein the housing assemblies are permanently installed on the rim.

14. The apparatus of claim 10 wherein the housing assemblies each comprise a rotatable housing grooved bearing wheel.

15. The apparatus of claim 10 wherein the lug assemblies are to be removably installed on the drum shell.

16. The apparatus of claim 10 wherein the lug assemblies each comprise a rotatable lug grooved bearing wheel.

17. The apparatus of claim 10 wherein the cable tension dial assembly is to be removably installed on the drum shell.

18. A kit for retrofitting the drum comprising the apparatus of claim 10.

19. A drumhead tuning rim apparatus for securing and tuning a drumhead on a drum shell of a drum, comprising:

a plurality of low friction housing assemblies installed spaced along a rim of the drum, the rim being seated over the drumhead on the drum shell;

a plurality of low friction lug assemblies installed spaced about the drum shell substantially between the respective housing assemblies;

a tensioning cable alternately passing between and about respective housing and lug assemblies substantially about the perimeter of the drum shell; and a cable tension dial assembly operably positioned on the drum shell and receiving opposite ends of the tensioning cable, whereby operation of the cable tension dial assembly effectively increases or decreases tension in the tensioning cable and thus raises or lowers the overall pitch of the drumhead.

20. The apparatus of claim 19 wherein the housing assemblies are to be removably installed on the rim.

* * * * *